US006104289A

United States Patent [19]

Rand

[11] Patent Number: 6,104,289

[45] Date of Patent: Aug. 15, 2000

[54] SUPERVISED ANTI-THEFT SECURITY SYSTEM FOR PRODUCT DISPLAYS

[75] Inventor: Richard Rand, East Northport, N.Y.

[73] Assignee: Protex International Corp., Bohemia, N.Y.

[21] Appl. No.: 09/329,896

[22] Filed: Jun. 10, 1999

[51] Int. Cl.[7] ..... G08B 13/14

[52] U.S. Cl. ..... 340/568.4; 340/568.1; 340/568.2; 340/691.1; 340/691.4; 439/917

[58] Field of Search ..... 340/568.4, 568.1, 340/568.2, 568.3, 691.1, 691.4, 693.5, 693.6, 693.8, 693.9; 439/917; 200/329, 341

[56] References Cited

U.S. PATENT DOCUMENTS

| | | | |
|---|---|---|---|
| 4,620,182 | 10/1986 | Keifer | 340/568.4 |
| 4,746,909 | 5/1988 | Israel et al. | 340/568.4 |
| 5,072,213 | 12/1991 | Close | 340/572.1 |
| 5,172,098 | 12/1992 | Leyden et al. | 340/568.4 |
| 5,341,124 | 8/1994 | Leyden et al. | 340/568.4 |
| 5,345,219 | 9/1994 | Rogers | 340/568.4 |
| 5,345,220 | 9/1994 | Wachsman | 340/568.4 |
| 5,508,682 | 4/1996 | Wachsman | 340/568.4 |
| 5,543,782 | 8/1996 | Rothbaum et al. | 340/568.4 |
| 5,552,771 | 9/1996 | Leyden et al. | 340/568.4 |
| 5,561,417 | 10/1996 | Rothbaum et al. | 340/568.4 |
| 5,821,857 | 10/1998 | Rand | 340/568.4 |
| 5,861,807 | 1/1999 | Leyden et al. | 340/568.4 |
| 5,995,003 | 11/1999 | Rogers | 340/568.4 |

*Primary Examiner*—Daniel J. Wu
*Assistant Examiner*—Toan Pham
*Attorney, Agent, or Firm*—Collard & Roe, P.C.

[57] ABSTRACT

An anti-theft product display system utilizes a command module and a plurality of sensor satellites arranged in a daisy chain configuration. The command module and sensor satellites operate with microprocessors and can be programmed to perform several operating functions. Each sensor satellite can receive up to eight sensors without requiring shunts or terminators for the unused sensor jacks. A data retention system is incorporated into each sensor satellite to prevent the loss of data in the event of power failure to the command module. The sensor is wired so that an alarm will sound if someone attempts to steal product by either disconnecting the sensor, cutting the sensor wire or shorting the system.

16 Claims, 7 Drawing Sheets

SUPERVISED ANTI-THEFT SECURITY SYSTEM FOR PRODUCT DISPLAYS

BACKGROUND OF THE INVENTION

1. Field of the Invention

The present invention relates to security and anti-theft devices. More particularly, it relates to a supervised anti-theft security system for consumer product displays.

2. The Prior Art

Anti-theft security systems are commonly used in many retail establishments, especially those that sell expensive and easily portable items such as consumer electronics. One way to prevent theft of the item is to physically lock it to a permanent surface via a cable lock. However, this does not prevent a thief from cutting the cable to steal the item. Another technique is a magnetized tag affixed to the item. When the thief attempts to leave the store with the item, he passes through magnetized gates which set off an alarm if the tag passes through.

Some security systems are a combination of physical restraint and electronic alarm. U.S. Pat. No. 5,821,857 to Rand, the disclosure of which is herein incorporated by reference, discloses an anti-theft security system having a command module and a plurality of sensor satellites arranged in a daisy chain configuration. The command module and sensor satellites operate with microprocessors. Each sensor satellite can receive up to 8 sensors each, so many different items can be monitored. No shunts or terminators are required for the unused jacks. Each sensor is attached to an item to be monitored. Cutting the wire or removing the sensor from the item causes an alarm to sound from the central command module.

While this device has many benefits, it does not protect the merchandise from being stolen by shorting the circuit by placing a pin through the wire, because the central command module cannot sense this change.

SUMMARY OF THE INVENTION

It is therefore an object of the present invention to provide an improved security system that signals when the item is being stolen or the sensor is being tampered with.

According to the invention, microprocessor technology is utilized in each sensor module (satellite) connected to the command module. The microprocessor and programming thereof enables the connection of multiple sensor modules to a command module. The command module includes indicator LED's for each sensor module connected to the system, a programmable keypad for controlling the unit, a key operated switch, a setup button and other indicator lights. The sensor modules/satellites are capable of receiving up to eight (8) sensors each and include status indicators for each sensor connected to the sensor satellite. Upon power up of the system, the programming of the processors within the sensor modules/satellites will scan all eight (8) of the modular jacks and determine which of them have sensors connected. Any modular jacks that do not have a sensor connected will be noted during the scanning process.

The overall system does not require that the maximum of ten possible sensor modules be connected to the command module to form a complete system. It can work with as few as a single sensor satellite, or as many as ten sensor satellites. After activation of the unit and arming of the system, the command module will constantly monitor the presence of all of the sensor satellites. This enables the command module to detect a break in the main control cable or the disconnection of a main control cable between sensor satellites. Under these circumstances, all of the modules beyond the break in the control would indicate an alarm condition on the command module, thus enabling a quick and easy determination as to where in the system the break occurred.

The sensor is wired to the system in such a way that attempts to short the circuit will also be detected. The sensor is connected to the satellite via 4 wires. Two wires are used for lighting the LED in the sensor and for presence detection by the microprocessor. Only one of these lines is in common with the LED in the alarm unit. The other line is dedicated to lighting the sensor LED and for presence detection by the microprocessor. The other two lines are for switch status and line shorting detection.

The presence of a sensor is detected by driving a current through the sensor LED and a parallel resistor/diode network. The microprocessor places a ground potential on the cathode side of the resistor/diode network. There will be enough current flow through the network and the LED in parallel to present a ground signal on the opposite LED line and thus detect the presence of a sensor. The diode in the network is to block unwanted current paths through the matrix when the LEDs are being driven. The sensor switch circuit consists of a switch with a blocking diode in series. Then, sensing the status of the switch in the sensor, the microprocessor places a ground potential on the cathode side of the switch circuit and attempts to sense the ground potential on the opposite side, thus indicating a closed switch. If the switch is open, the line is pulled to a high voltage potential via a pullup resistor. When checking for a shorted cable, the microprocessor presents a ground potential on the anode side of the sensor switch wiring. With this condition, the diode is reverse biased and the only way a ground can be detected on the cathode side is if the lines are shorted. If a ground is detected under this condition, an alarm is activated by the microprocessor.

BRIEF DESCRIPTION OF THE DRAWINGS

Other objects and features of the present invention will become apparent from the following detailed description considered in connection with the accompanying drawings which disclose an embodiment of the present invention. It should be understood, however, that the drawings are designed for the purpose of illustration only and not as a definition of the limits of the invention.

In the drawings, wherein similar reference characters denote similar elements throughout the several views.

DETAILED DESCRIPTION OF PREFERRED EMBODIMENTS

Figure 1A:
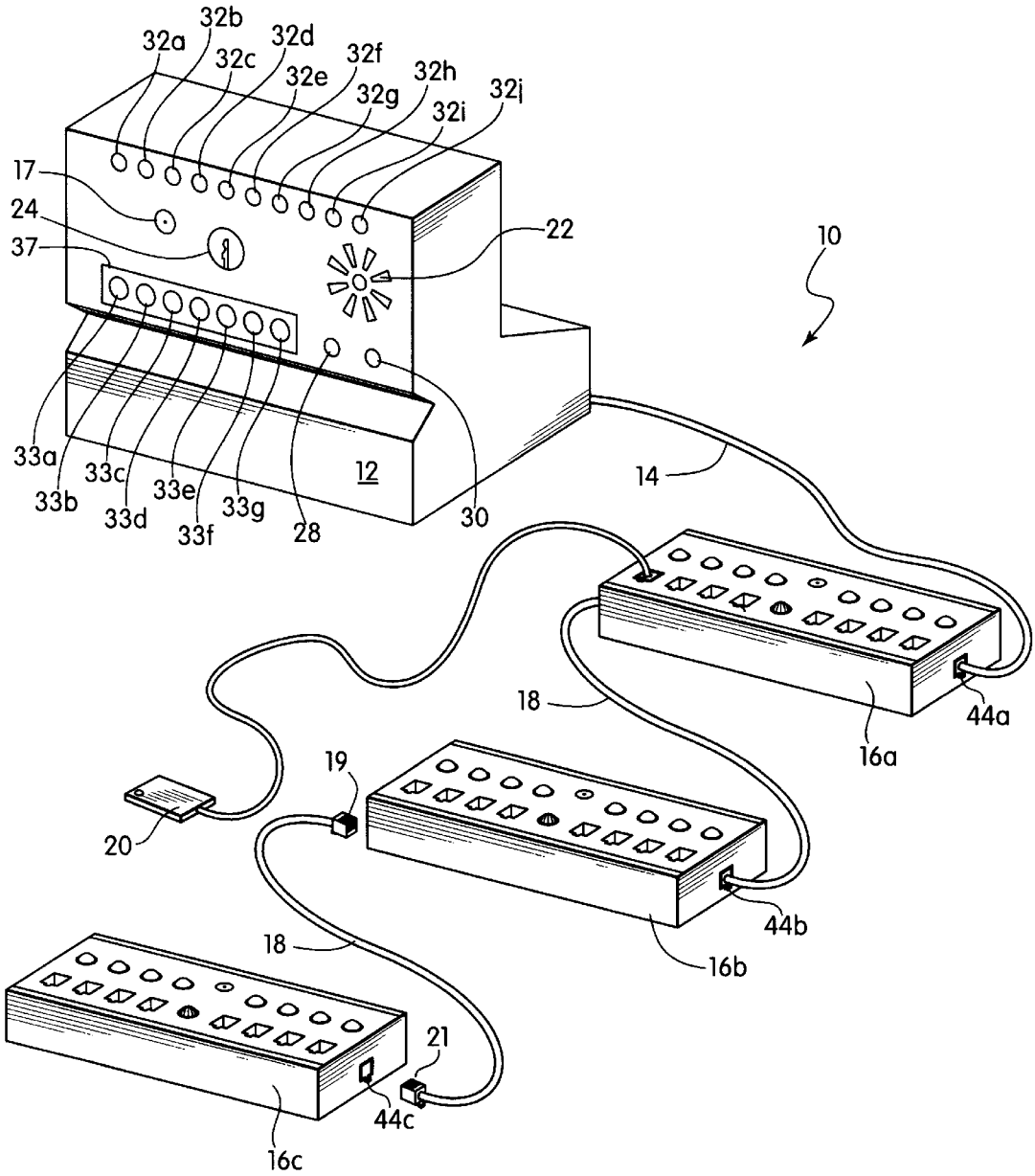
FIG. 1*a* is a perspective diagram of the anti-theft security system according to the invention.

FIG. 1*a* shows the anti-theft product display system 10 according to the invention. System 10 includes a command module 12 connected with a group of sensor satellites 16*a*, 16*b*, 16*c*, etc. A connection wire 14 connects command module 12 to the first sensor satellite 16*a* in the chain. Subsequent sensor satellites are connected to the previous satellites in a daisy chain configuration with satellite connection wire 18. Each satellite 16 can accommodate a group of sensors 20 for attachment to the products being displayed.

FIG. 1*a* shows command module 12 according to the invention. Command module 12 includes an AC power indicator 30 and a low battery and no battery indicator 28. AC power indicator 30 provides an indication as to the current operating power conditions of the command module, and indicates whether or not a power connector is attached. Command module 12 includes a group of indicator lights 32*a*–32*j*, each for indicating the current operating status of one of the sensor satellites connected to said command module. Command module 12 also has an internal speaker 22 for producing an audible alarm signal. A setup key switch 24 has a dual function and enables the user to turn on and off the programming mode of the command module, or can be used to override the use of keypad 37. Command module 12 includes a main button 17 for placing the command module in the setup and programming mode.

A programmable keypad 37 having keys 33*a*–33*f* provide operator control and specialized operating features to the system when in programming or setup mode. An indicator LED 39 provides a visual indication as to the current operating mode of the command module. LED 39 has five operating modes: 1) solid green, indicating the system is armed and operating; 2) flashing green indicates the unit has been silenced via keypad 37 or keyswitch 24, but there are existing alarm conditions; 3) solid red, indicating the unit is in setup mode #1 (i.e., satellites or sensors may be added or removed); 4) flashing red, indicating configuration mode where system options may be set or reset via keypad 37; and 5) fast flashing red indicating code change mode where the operation key code may be changed.

Figure 1B:
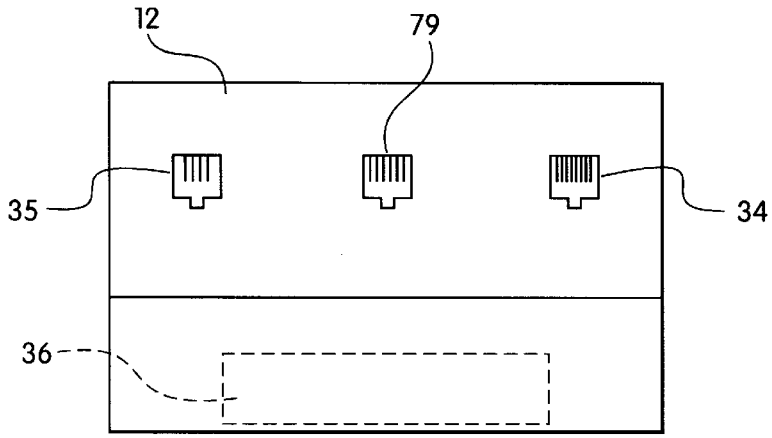
FIG. 1*b* is a rear view of the command module according to the invention.

FIG. 1*b* shows the rear of command module 12 which has an eight (8) pin modular receptacle 34 for connection to the first sensor satellite 16*a* in the chain. A four (4) pin modular receptacle 35 is provided for receiving a plug in DC power supply (not shown) that supplies 6 volts DC power to the system. A six (6) pin modular receptacle 79 is provided for connection of an external alarm annunciator. A battery pack 36 can be disposed within command module 12 to provide primary or backup power to the system. In the preferred embodiment, battery pack 36 is a backup power supply in the event of power failure to jack 35.

Figure 2A:
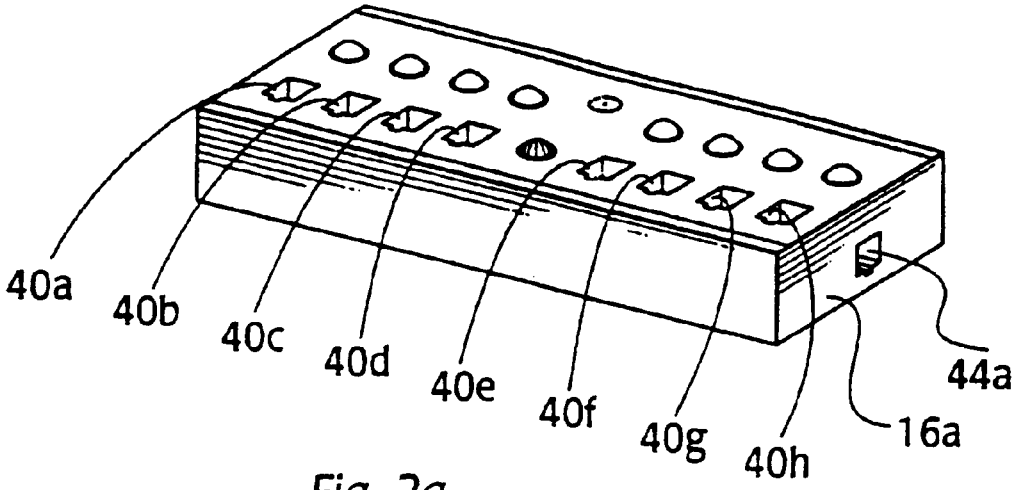
FIG. 2*a* is a right side perspective view of a sensor module according to the invention.
Figure 2B:
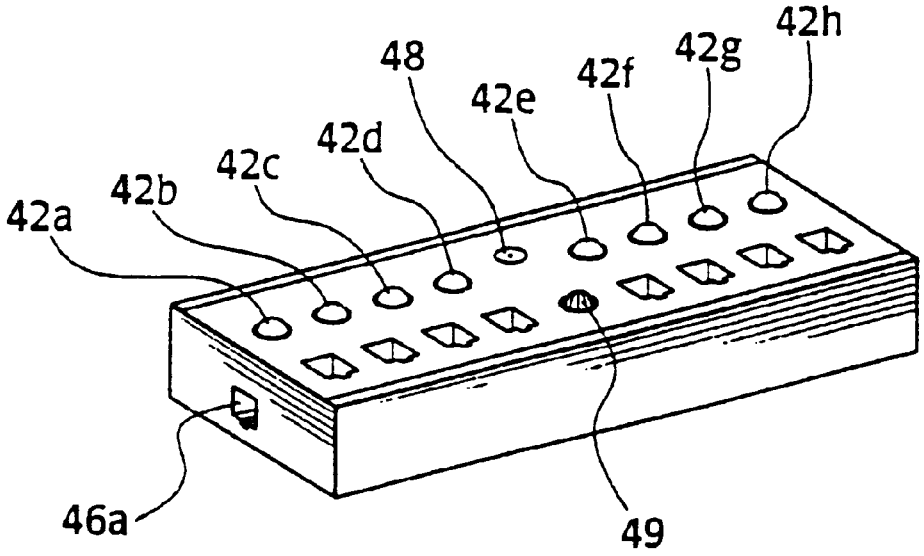
FIG. 2*b* is a left side perspective view of the sensor module according to the invention.

FIGS. 2*a* and 2*b* show the sensor satellite 16*a* according to the invention. Each sensor satellite 16 has eight (8) modular jacks 40*a*–40*h* for connecting up to eight (8) sensors 20 (FIGS. 4*a*, 4*b* and 5). The modular jacks 40*a*–40*h* each have a corresponding status indicator 42*a*–42*h*, respectively, for indicating the current operating status of the sensor connected to that specific modular jack. Status indicators 42*a*–42*h* are preferably bi-color LEDs, having red and green operating modes, however they may be any suitable type of indicator light that is capable of displaying two distinguishable colors.

Satellite 16*a* has a first connection port or eight (8) pin modular jack 44*a* on one side for connecting said module to the modular jack 34 on the rear of command module 12. A second connection port or eight (8) pin modular jack 46 is located on the opposite side of satellite 16 and is for connecting the satellite to another satellite of the same type. FIG. 1*a* shows a first satellite 16*a* connected to command module 12 via connection cable 14 and the 8 pin modular jack 44*a*. The satellite connection wire 18 has an eight (8) pin modular plug at one end for connecting to modular jack 46*a* in satellite 16*a*, and an eight (8) pin modular plug at the other end for connecting to modular jack 44*b* in the satellite 16*b*, with a daisy chain type connection.

Satellite connection wire 18 and connection ports/modular jacks 44 and 46 enable the connection of up to ten (10) satellites 16 to command module 12 in a daisy chain series connection. Although modular jacks 34, 44, 46 and 40 are shown and described to be 8 pin, 8 pin, 8 pin, and 4 pin, respectively, other sizes may be incorporated without departing from the scope of the invention.

Each sensor satellite 16 includes a local reset button 48 (FIG. 2*b*) for locally resetting the specific satellite when an alarm condition occurs at that module. In one configuration, when an alarm condition occurs at any of the satellites 16 connected to command module 12, on/off (reset) key 24 or a proper code entry on keypad 37 can globally reset the entire system from the command module location. In this instance, the local reset button 48 on each satellite module is not necessary. In a second configuration, an alarm condition can be reset by requiring the user to reset the system using reset key 24 or the proper code entry on keypad 37, and then reset the specific satellite locally via reset button 48. The ability to switch between the global reset condition and the local reset condition is provided by programming performed through keypad 37 on command module 12 (FIG. 1*a*) prior to initiating operation.

Figure 3A:
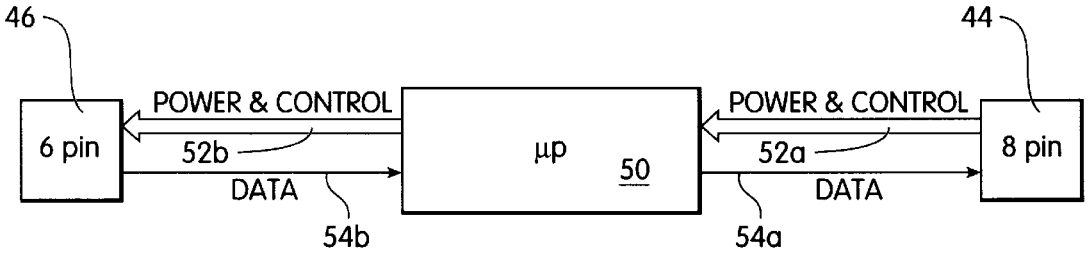
FIG. 3*a* is a block diagram of the sensor module according to the invention.

FIG. 3*a* shows a block diagram of the sensor satellite 16 according to the invention. A microprocessor 50 is coupled to the first connection port/modular jack 44 via power and control lines 52*a* and data line 54*a*. On the other side, microprocessor 50 is connected to the second connection port/modular jack 46 via power and control lines 52*b* and data lines 54*b*. Power and Control lines 52*a* and 52*b* carry power and control information from command module 12 to each of the satellites connected in the chain. Data lines 54*a* and 54*b* carry the data information from each of the satellites back to command module 12.

Figure 3B:
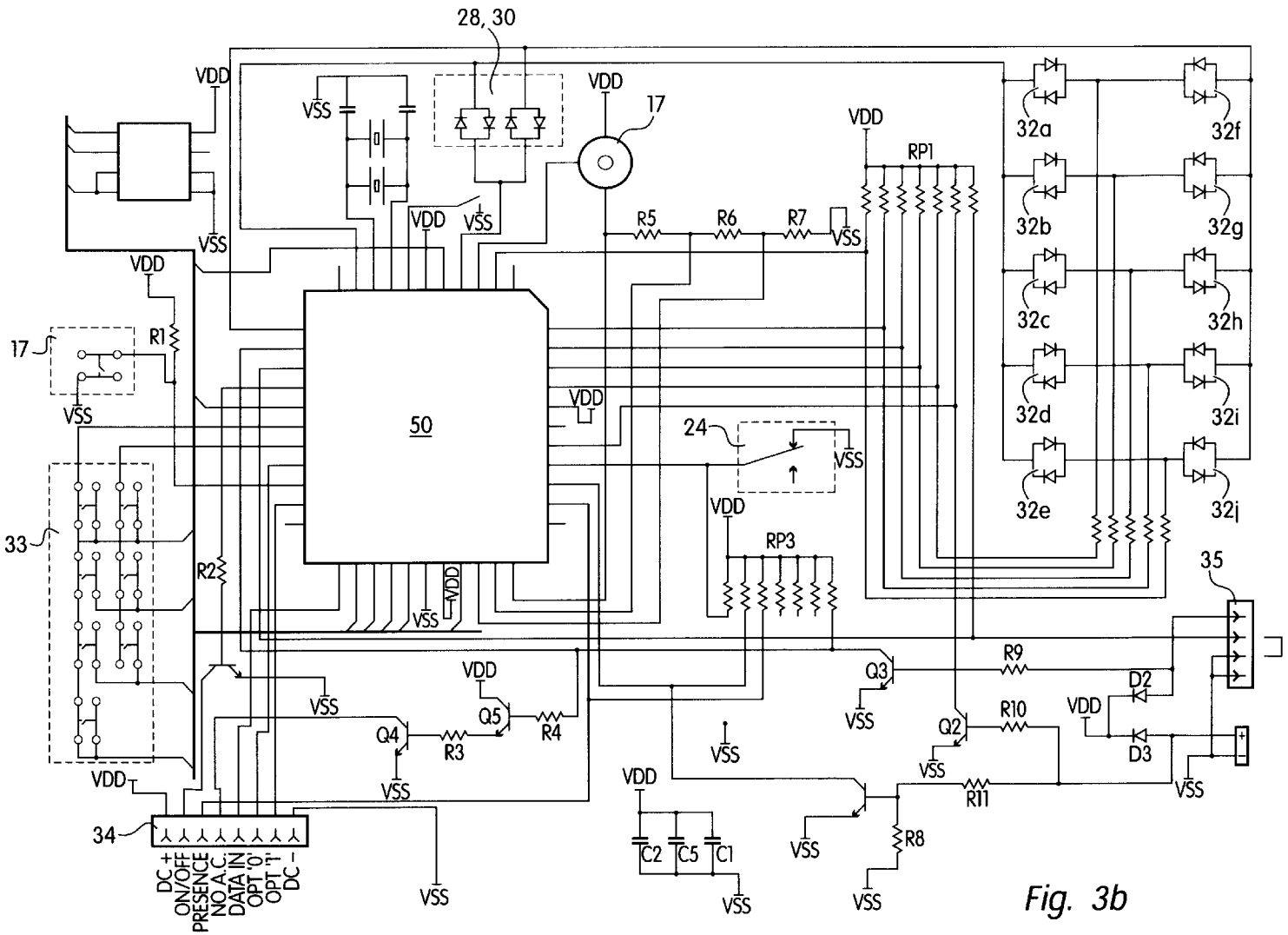
FIG. 3*b* is a schematic diagram of the command module circuit according to the invention.

FIG. 3*b* shows a schematic circuit diagram of the command module 12 according to the invention. Command module 12 receives its operating power through jack 35. Jack 35 is a four (4) pin connector which receives AC power on two of the four pins, and the other two pins are looped out through the plug-in DC power supply to detect the presence of the plug. If the plug is not present, the unit goes into a special alarm mode and indicates this on an AC power LED 30.

A battery 36 provides backup power to the system in the event of power failure to jack 35. A diode isolates the incoming power supply from the battery pack to prevent current direction problems between the incoming power and the battery. Both the incoming power and battery supplies are broken off before the isolating diode and routed to the processor and a monitor to determine the presence of a battery, the condition of the battery, and the presence of the plug-in DC power supply and DC power.

Once powered up, command module 12 runs through an initialization that is transparent to the user. The initialization determines the presence of the satellite modules, and places the command module in a wait state where it awaits communications from the connected satellite modules. The communication comes in on the data in line of jack 34. The data transmission is a serial communication and is presented to the command module in packets of four bytes. The input data is broken up into two pieces: (1) the presence of a satellite; and (2) the condition of the satellite, if present. Command module 12 will light the corresponding LEDs 32*a*–32*j* according to the satellite modules present and their current operating condition. No LED lit indicates no satellite connected, a green LED indicates the presence of a satellite, and a flashing red LED indicates an alarm condition on the particular satellite.

Keypad 33 is a group of six buttons (33*a*–33*f*) that provide programmable features for configuring command module 12, and for code control without a key. Among the programmable features are: the type of alarm sound (e.g., fast pulse, slow pulse, or steady tone), whether the satellite modules require local reset via button 48, whether the satellite's local sounding is activated via speaker 49, and setting the volume of the speaker when in alarm.

Resistor blocks RP3 and RP1 are pullup resistor blocks for preventing the respective inputs from floating or oscillating. Resistor block RP1 pulls up the "A" ports on processor 50 which are used to drive LEDs 32*a*–32*j*. The LEDs 32*a*–32*j* that are not lit upon initialization (i.e., no satellite module present) are actually floating inputs, and require pullup resistors RP1.

Sounding device 17 is a piezo device that is connected across the power supply in series with a volume controlled resistor divider network for allowing the user to vary the volume of the alarm. Sounding device 17 is coupled to processor 50 and receives its signal instruction from the processor.

Processor 50 is a PIC16C65 RISC processor that has a limited instruction set, and internal communications which operate as a serial communications port. Therefore, the serial communication between command module 12 and satellites 16 is performed through the use of serial communication processors 50.

Switch 24 is the keyswitch on command module 12 and operates to override the use of keypad 37 and allows the user to place the command module 12 in a setup or programming mode. Switch 24 activates a mechanical cam lock that physically activates SW1 for performing these functions.

The satellites 16 are connected to the system in series via input (46) and output (44) jacks. The last satellite in the chain, or the one furthest from the command module detects the fact that it does not have another satellite connected to it's input jack 46. This satellite determines that it is the source of all transmissions and begins transmitting data as to it's own status back toward the command module. The next satellite in the chain (i.e., next closer to the command module) receives the data transmission from the previous satellite, adds its own data, and retransmits it along the line. This process continues until the command module processor has obtained the number of satellites present, and the condition of each.

The communications are such that the satellites transmit data every 250 milliseconds. Therefore, when operating at 2400 baud, the highest possible delay could be up to 0.5 second. Pin 3 of jack 34 is a presence detection line for enabling the processor to detect the presence or lack thereof of a satellite. There are two ways to detect that there is no satellite connected. One is the lack of a signal on pin 3, the other is an overall lack of communication for a predetermined period of time, such as, for example, 4 seconds. Pin 4 of jack 34 is the data pin for indicating the presence of AC power to the command module. If there is no AC power to the command module and it is operating on battery power, the satellites are notified of this condition and the LED's in the system are extinguished to save battery power.

The LEDs 32*a*–32*j* are arranged in a matrix where rows and columns are activated depending upon the presence of power, and the color is changed according to the polarity of the power applied. The activation of the LEDs is software driven and can be performed in two groups of five, or five groups of two. For example, if polarity is put on the junction of LEDs 32*a* and 32*f*, the corresponding opposite power of the common connections for LEDs 32*a*–32*e*, or LEDs 32*f*–32*j*, will determine if that LED lights or not. Microprocessor 50 lights LEDs 32*a*–32*j* according to the data it receives and must present, and therefore will not attempt to activate an LED as an output that is not required to be as such according to the input data received. Resistor group MD5-47 are current limiters for LEDs 32*a*–32*j* and provide proper operation thereof. Low battery indicator 28 monitors the battery directly through a voltage divider, and when the voltage at the base of transistor Q1 drops below 0.7 volts, the low battery indicator is illuminated to indicate the low battery condition.

Figure 3C:
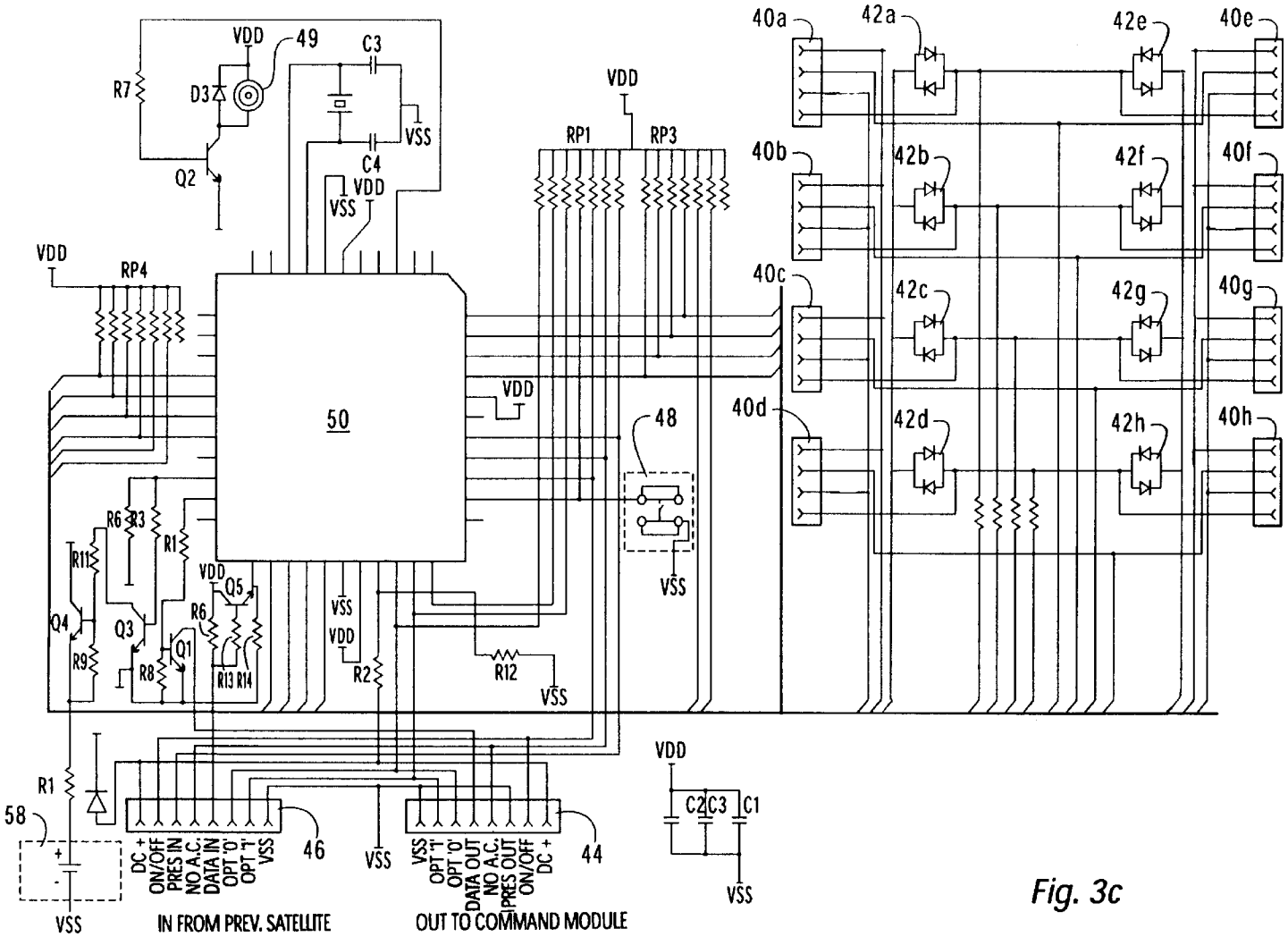
FIG. 3*c* is a schematic diagram of the sensor module circuit according to the invention.

FIG. 3*c* shows a schematic diagram of a satellite module 16 according to the invention. The satellite module has an input jack 46 for receiving input data from a previous satellite in a chain, and an output jack 44 for sending data out toward the command module. The data stream from the satellites is unidirectional toward the command module. Most of the signals between input 46 and output 44 are common. $V_{dd}$ and $V_{ss}$ are common to both and are fed through from satellite to satellite supplying power. The on/off and AC power signals are also paralleled right through from input 46 to output 44. The data in pin 5 of input 46 feeds directly to the processor and the data out pin 4 of output 44.

A presence signal can be received on pin 3 of input 46 to indicate the presence of a satellite in the chain that is further away from the command module. When there is a satellite connected to input 46, pin 3 is shorted to ground from the previous processor of the previous satellite. As can be seen on output 44, pin 6, which is a presence out indicator, is tied to ground ($V_{ss}$). Thus, when pin 3 of input 46 is grounded, the processor in that satellite knows that there is another satellite connected further down the chain. Therefore when input 46 is open, and pin 3 is not grounded, the satellite processor knows it is the first satellite in the chain or the source of communication, and begins transmitting data through output 44.

A sound alarm 49 is provided to enable an optional local audible alarm for each satellite. When selected, the alarm 49 will provide a local alarm sound at the satellite location.

A lithium battery 58 is provided within each satellite 16 to prevent the loss of data from the satellite in the case of a power failure from the command module. Battery 58 is connected with a switching mechanism and the processor such that when the power fails from the command module while in the armed state, the switching system switches power over to the battery 58 and continues to operate the satellite even though it is disconnected from the command module. When operating with battery power, the satellite will continue to scan its inputs and latch any violations, such that when the command module power is restored, the violations that occur during the power failure are indicated on the command module. Thus, battery 58 provides a data retention feature for each satellite connected to the system and prevents a perpetrator from disconnecting the satellite and then disconnecting a sensor. Should the command module power be disconnected for a period greater than 48 hours, the satellite processor will shut down the respective satellite to prevent over draining of battery 58. If the satellite is disconnected while the system is disarmed, the internal battery 58 will disconnect itself immediately.

Figure 4:
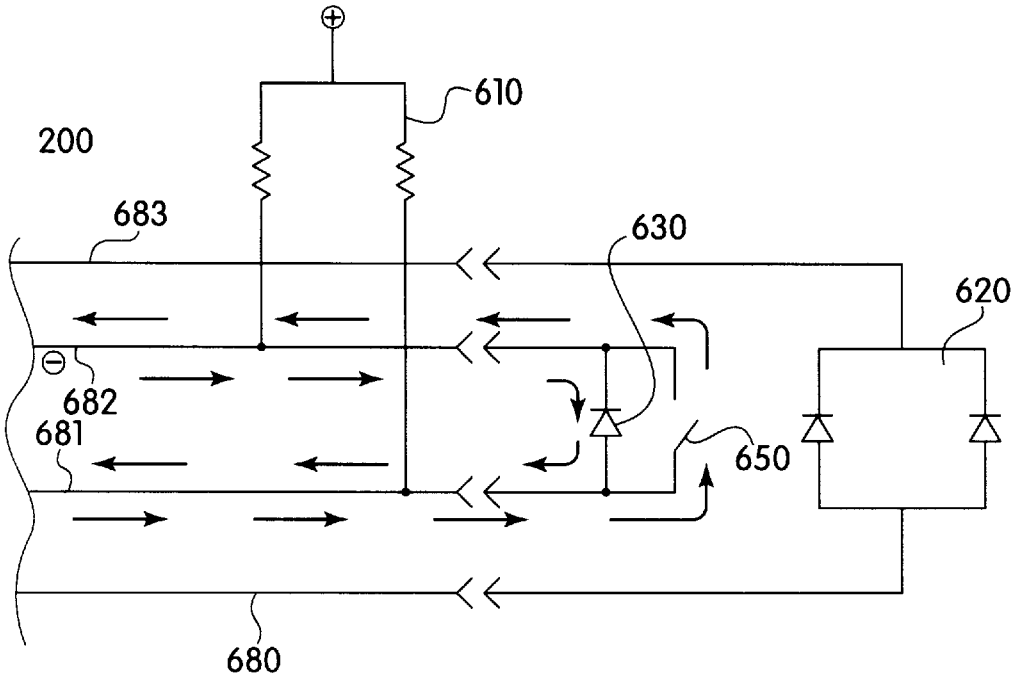
Fig. 4 (Prior Art)
FIG. 4 is a schematic diagram of a prior art sensor.
Figure 5:
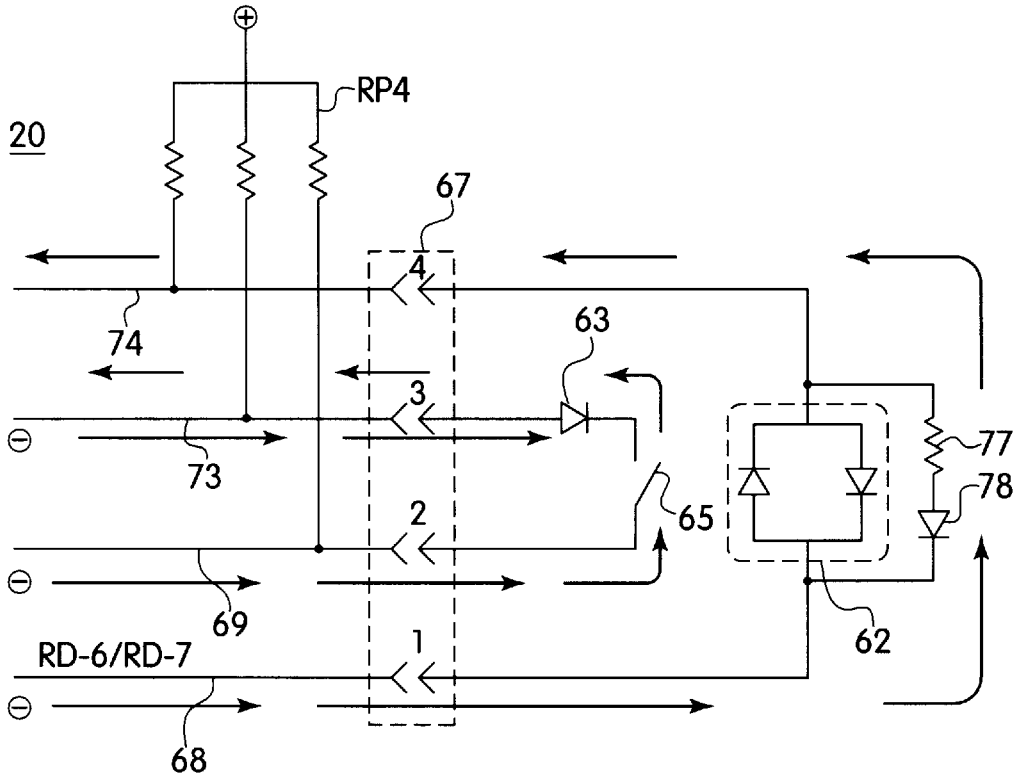
FIG. 5 is a schematic diagram of the sensor according to the invention.

FIG. 4 shows a wiring diagram of a prior art sensor 200 such as shown in U.S. Pat. No. 5,821,857 to Rand. In the prior art, the sensor is connected to the monitoring system via 4 wires, 680, 681, 682 and 683. Wires 680 and 683 are dedicated to lighting LED 620. Wires 681 and 682 are used for presence detection and sensing. The fact that sensor 200 is connected to the system is detected by diode 630 mounted across sensor switch 650. When sensing the status of the switch, the microprocessor 50 forward biases diode 630 by placing a ground potential on the cathode side and detects the ground on the opposite side. If a sensor is present, the ground will be detected regardless of the position of switch 650 since current goes through diode 630. If a sensor is not present, a resistor pulls the signal to a high voltage. When sensing the status of the switch, microprocessor 50 reverse biases diode 630 by placing a ground on the anode of diode 630 and detects the presence of the ground on the opposite side of switch 650. If switch 650 is closed, the ground will be present. If switch 650 is open, the signal is pulled high by pullup resistor 610. If wires 681 and 682 are shorted together, microprocessor 50 will always see the return ground, either for presence or switch status, and thus defeat the security of sensor 200.

Figure 6:
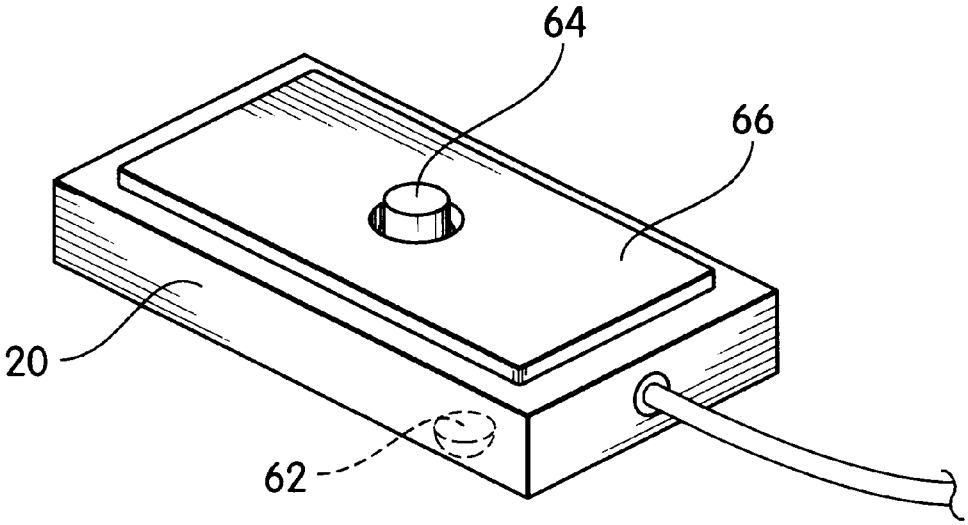
FIG. 6 is a perspective view of a first embodiment of the sensor according to the invention.

FIGS. 5 and 6 show a wiring diagram and a perspective view of a sensor 20 according to the invention, respectively. Sensor 20 is connected to one of the modular jacks 40 on sensor satellites 16 with modular plug 67, via sensor wire 68. An adhesive foam tape 66 is used to affix sensor 20 to the product being displayed. A switch 65, contained within sensor 20, is closed by depressing plunger 64 when the sensor is attached to a displayed product to complete the circuit. Thus, sensor 20 is in a secure state. When switch 65 is open, resulting from the removal of the sensor from the displayed product for any reason, sensor 20 is in an unsecure state.

Sensor 20 is also connected to microprocessor 50 via 4 wires 68, 69, 73 and 74. Wires 68 and 74 are connected to LED 62 and serve for presence detection of sensor 20 by microprocessor 50. Only one of wires 68 and 74 is connected with the alarm unit. The other wire is dedicated to lighting LED 62 and for detecting the presence of sensor 20 by microprocessor 50.

LED 62 is a bi-color LED having one color for indicating a secure state, and another for indicating an unsecure state. Although the colors for LED 62 can be any suitably distinguishable colors, in the preferred embodiment of the invention, LED 62 is green when sensor 20 is in a secure state, and red when in an unsecure state.

To sense the presence of sensor 20, processor 50 drives port pin RD6 from a high impedance input to a ground output, as shown in FIG. 3*c*. The ground is presented on pin 1 of jacks 40*a*–40*d* and enters the sensor on pin 1, and if the sensor is present, the signal will drive pin 4 of the sensor to ground through diode 78, resistor 77, in parallel with LED 62 in sensor 20.

When pin 4 of sensor 20 is grounded, the corresponding sense signals (i.e., SENS1-5, SENS2-6, SENS3-7, SENS4-8) are grounded. The sense signals are read by the processor on port pins RD0–RD3. When the processor reads these signals, any signal not pulled to ground through the sensor diode will be pulled high by pullup resistors RP4. This process is repeated for jacks 40*e*–40*h* by allowing RD6 to return to a high impedance state and driving port pin RD7 to a ground output and again reading the information on port pins RD0–RD3. On this read step, the presence of sensors on jacks 40*e*–40*h* will be detected. Once complete, port pin RD7 is returned to a high impedance state.

Wires 69 and 73 of sensor 20 detect the status of switch 65 and detect any short circuits in the system. The presence of sensor 20 is detected by running a current through LED 62 along with a resistor 77 and diode 78 wired in parallel to LED 62. There is enough current flow through resistor 77 and diode 78 to present a ground signal on LED 62 to detect the presence of sensor 20. Diode 78 blocks unwanted current paths through the matrix when LED 62 is being driven.

Once the sensor presence scan is complete, the satellite must read the conditions of the sensor switches of the detected sensors. In order to do this, processor 50 drives port pins RD4 (SW1–4) from a high impedance input to a ground output. This ground is presented on pin #2 on jacks 40*a*–40*d*; and if a sensor switch is closed, the signal will drive pin #3 of the sensor 20 to ground. When pin #3 is driven to ground, the corresponding sense signals (i.e., SENS1-5, SENS2-6, SENS3-7, SENS4-8) are also grounded. These sense signals are read on port pins RD0–RD3. When processor 50 reads these signals, any signal not pulled to ground will be pulled high by pullup resistor RP4. This process is repeated for jacks 40*e*–40*h* by allowing RD4 to return to a high impedance state, and driving port pin RD5 (SW5–8) to a ground output and reading the data on RD0–RD3.

When checking for a shorted wire, microprocessor 50 presents a ground potential on the anode side of diode 63 connected to switch 65. With this condition, diode 63 is reverse biased and the only way a ground can be detected on the cathode side is if conductors 69 and 73 are shorted. If a ground is detected under this condition, an alarm condition is activated by microprocessor 50. This overcomes the possibility of defeating the security of the system by shorting sensor leads 69 and 73 with a pin or other object.

As shown in FIG. 3C, the lighting of LEDs 42*a*–42*h* are driven in four (4) stages, where each stage attempts to light 4 LEDs once for each color. Stage 1 attempts to light LEDs 40*a*–40*d* green. The lighting data for green LEDs 40*a*–40*d* is presented on port A (RA0–RA3) of the processor 50. Any LEDs to be lighted green will put a ground signal on the corresponding bit. The processor then drives port pin RD6 (LED1–4) and port pin RA5 (ILED1–4) to a 6 volt output. This causes any of the port pins RA0–RA3 (and thereby the corresponding LED) with a ground signal to light green.

Stage 2 of the LED lighting deals with LEDs 40*e*–40*h*. The lighting data for green LEDs 40*e*–40*h* is presented on port A of the processor (i.e., RA0–RA3). Again, any LEDs to be lighted green with put a ground signal on the corresponding bit. The processor then drives port pin RD7 (LED 5–8) and port pin RC4 (ILED5–8) to a 6 volt output. This causes any of the port pins RA0–RA3 (and corresponding LED) with a ground signal to light green.

Stage 3 attempts to light LEDs 40*a*–40*d* red. The lighting data for red LEDs 40*a*–40*d* is presented on port A (RA0–RA3) of the processor. Any LEDs to be lighted red will put a 6 volt signal on the corresponding bit of data. the processor then drives port pin RD6 (LED1–4) and port pin RA5 (ILED1–4) to a ground output. This causes any of the port pins RA0–RA3 with a 6 volt signal to light the corresponding LED red.

Stage 4 attempts to light LEDs 40*e*–40*h* red. The lighting data for red LEDs 40*e*–40*h* is presented on port A (RA0–RA3) of the processor. Any LEDs to be lighted red will put a 6 volt signal on the corresponding bit of data. the processor then drives port pin RD7 (LED5–8) and port pin RC4 (ILED5–8) with a ground output. This causes any of the port pins RA0–RA3 with a 6 volt signal to light the corresponding LED red.

The transfer of data between the satellites 16*a*, 16*b*, 16*c* . . . etc. and command module 12 is performed in packets of information. Each packet consists of 4 bytes. The first byte (#1) holds the presence data for satellites electrically designated 1–5. The second byte (#2) holds the presence for satellites electrically designated 6–10, byte #3 holds the alarm information for satellites 1–5 and byte #4 holds the alarm information for satellites 6–10.

The presence and alarm data are stored in individual bits of their respective bytes. For example, the satellite furthest from the command module detects that it is the last satellite in the chain, and therefore is the source of all communications. This satellite will set the presence bit for the first satellite (actually the last electrically designated satellite when displayed) in byte #1, and if necessary will set the alarm bit for the first satellite in byte #3. After this, a parity bit is calculated for each byte added.

All four bytes are then transmitted to the next satellite in the chain. This satellite examines the input data and determines which bit it needs to set to show its presence. Once determined, the satellite then knows which bit to set to indicate an alarm, if necessary. Parity is again recalculated, and the data is re-transmitted. Any error in the data or parity will cause the satellite to disregard the entire packet of information and wait for another packet. The satellite must receive valid data before it can retransmit. This process continues until the command module receives the data. The command module manipulates the bits such that the last presence bit added is displayed as the first satellite in the system. Any corresponding alarm bits set will display alarm conditions.

With the system in normal operating condition (i.e., armed and monitoring the various equipment retail items), removing a sensor plug from a previously used jack or inserting a sensor plug into a previously unused jack, will activate the alarm. This is because the satellites, upon turn-on and activation, have determined which jacks should be vacant and which should not. Thus, it can determine whether a sensor is present that was not initially present, or a sensor is not present that was initially present. In either case, the system will register alarm because of disruption of the initial configuration of the sensor module. In other words, when the system is turned on, the microprocessor is initialized to those sensors which are already plugged in and also the ones that are not, or the vacant four pin terminals, through its volatile memory. Any change in the volatile memory of the microprocessor while the system is on, such as the removal of a four-pin connector or the plugging in of a new four-pin connector will be sensed by the microprocessor as being different than its initialized state and thus set off an alarm.

Figure 7:
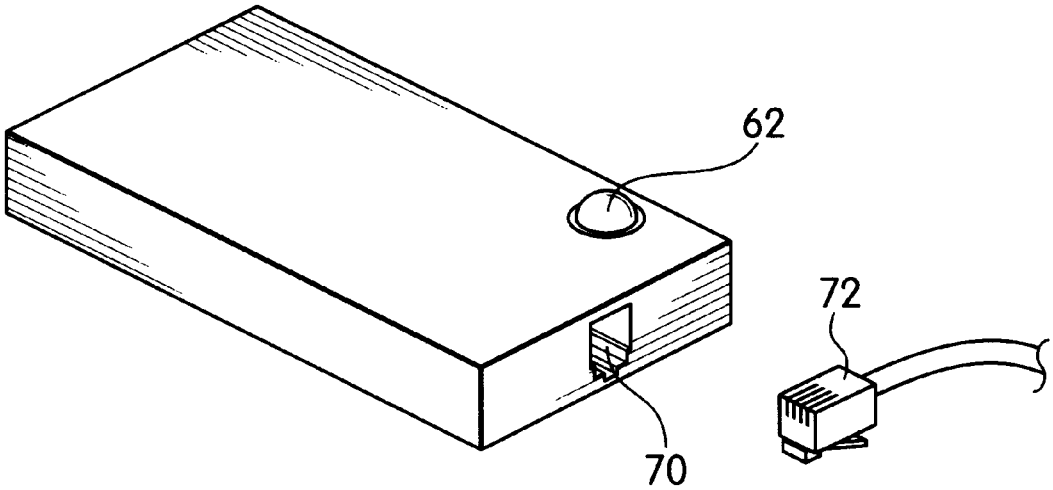
FIG. 7 is a perspective of a second embodiment of the sensor according to the invention.

FIG. 7 shows a second embodiment of sensor 20 according to the invention. Sensor 20 includes a modular jack 70 for receiving modular plug 72 on the sensor connection wire 68. In this embodiment, the sensor can be disconnected with the sensor module without having to remove sensor itself from the displayed product.

While only a few embodiments of the present invention have been shown and described, it is to be understood that many changes and modifications may be made thereunto without departing from the spirit and scope of the invention as defined in the appended claims.

What is claimed is:

1. An computer-controlled anti-theft security system for product displays comprising:

a command module having a front panel, a back panel, power supply means for providing power to the system, a sensor satellite connection receptacle and a programmable device, said programmable device including:

(a) a command module micro-processor electrically coupled to said power supply means and said satellite connection receptacle;

(b) a keypad electrically coupled to said command module micro-processor and disposed on said front panel of said command module, to generate user selected operating instructions to said command module microprocessor, the instructions configuring the anti theft security system to operate in a predetermined configuration;

at least one sensor satellite coupled to the satellite receptacle of said command module, said at least one sensor satellite having a satellite input port, a satellite output port, a plurality of sensor connection jacks, and a plurality of status indicators, wherein said satellite input port and said satellite output port connect additional sensor satellites;

a satellite micro-processor electrically coupled to said satellite input port, said satellite output port, said plurality of sensor connection jacks and said plurality of status indicators; and at least one sensor adapted to be attached to a displayed product and having a four sensor wires for electrically coupling said sensor to one of said plurality of sensor connection jacks, said sensor comprising:

(a) a bi-color LED coupled in parallel with a series connection of a resistor and a diode via two of said sensor wires;

(b) a switch coupled in series with a blocking diode via said other two sensor wires; and (c) a pullup resistor connected in parallel with one of said sensor wires connected to the LED and both of said other two sensor wires, so that when the sensor is connected to the command module via the sensor satellite, the command module detects the presence of said sensor and wherein when said switch is closed, said LED indicates a secured state and wherein cutting or short circuiting said wires or opening said switch causes said LED to indicate an unsecure state.

2. A computer-controlled anti-theft security system according to claim 1, wherein said power supply means comprises:

a power jack disposed on the back panel of said command module;

a DC power supply releasably connected to said power jack and adapted to provide DC power to said command module; and a backup power supply for maintaining the operation of the security system when said DC power supply fails.

3. A computer-controlled anti-theft security system according to claim 2, wherein said command module further comprises:

a plurality of indicator lights corresponding to each of said at least one sensor satellites connected to said command module, said plurality of indicator lights controlled by said command module micro-processor;

an on/off keyswitch adapted to activate and deactivate the security system;

a speaker adapted to provide audible alarm sounds during operation of the system, said speaker being controlled by said command module micro-processor;

an AC power indicator adapted to provide power status indication to the user, said AC power indicator controlled by said command module micro-processor; and a backup power supply indicator adapted to provide status of the backup power supply.

4. A computer controlled anti-theft security system according to claim 3, wherein said indicator lights are LED lamps.

5. A computer controlled anti-theft security system according to claim 3, wherein said on/off keyswitch will reinitialize the command module micro-processor and thus reset the system after the alarm goes off provided no sensor alarm state exists.

6. A computer-controlled anti-theft security system according to claim 3, wherein the removal of any sensor or disconnection of any satellite module will be sensed by said command module microprocessor to trip the alarm on said command module.

7. The anti-theft security system according to claim 1, wherein said at least one sensor satellite further comprises:

a speaker coupled to said satellite microprocessor and being adapted to selectively provide an audible alarm; and a local reset button coupled to said satellite microprocessor and being adapted to selectively reset said sensor satellite after an alarm condition, said local reset button being activated or deactivated by said programmable device of said command module.

8. A computer controlled anti-theft security system according to claim 1, wherein said satellite microprocessor is adapted to receive input data from said sensors and generate output data representative of the current operating status of said sensor satellite and any sensor satellites additionally connected to said satellite input port regardless of the presence of said sensor in said sensor connection jack.

9. A computer-controlled anti-theft security system according to claim 8, wherein said satellite microprocessor further comprises:

means for receiving from said additionally connected satellites binary input dat wherein 0 represents ground and 1 represents an elevated state;

means for examining said binary input data;

means for generating binary output data in the form of 32 bits (four 8-bit bytes) representative of the current operating status of said sensor satellite and any sensor satellites additionally connected to said satellite input port regardless of the presence of said sensor in said sensor connection jack, and means for transmitting said binary output data to either another said sensor satellite micro-processor or said command module micro-processor.

10. A computer controlled anti-theft security system according to claim 9, wherein said satellite microprocessor further comprises:

means for calculating a parity bit of said binary output data for each byte added, means for checking said parity bit of said binary input data, means for waiting and accepting additional binary input data in the event said parity bit signals an error, and means for transmitting said parity bit with said binary output data.

11. A computer-controlled anti-theft security system according to claim 1, wherein said at least one sensor satellite comprises up to 10 satellite modules coupled in series with each other.

12. A computer-controlled anti-theft security system according to claim 1, wherein each satellite module has up to 8 sensor connection jacks for receiving up to 8 sensors.

13. A computer-controlled anti-theft security system according to claim 1, wherein the keypad is adapted to activate and deactivate said computer-controlled anti-theft security system.

14. A computer-controlled anti-theft security system according to claim 1, wherein a keyswitch activates said keypad to permit the user to generate user selected operating instructions to said command module microprocessor.

15. A computer-controlled anti-theft security system according to claim 1, wherein a battery is electrically connected to said sensor satellites to maintain functionality when said sensor satellite is disconnected from said command module while activated.

16. A computer controlled anti-theft security system according to claim 1, wherein said at least one sensor further comprises:

a housing having an interior space, an outer surface and at least one aperture in said outer surface;

a plunger on the switch, said plunger extending through said aperture beyond said outer surface; and attachment means for securing said housing to a displayed product such that said switch is in a secure state.

* * * * *